US010839652B2

(12) United States Patent
Kido

(10) Patent No.: US 10,839,652 B2
(45) Date of Patent: Nov. 17, 2020

(54) COIN PUSHER CASINO GAME

(71) Applicant: ARUZE GAMING (HONG KONG) LIMITED, Hong Kong (HK)

(72) Inventor: Katsuhiro Kido, Tokyo (JP)

(73) Assignee: ARUZE GAMING (HONG KONG) LIMITED, Hong Kong (HK)

( * ) Notice: Subject to any disclaimer, the term of this patent is extended or adjusted under 35 U.S.C. 154(b) by 0 days.

(21) Appl. No.: 16/231,136

(22) Filed: Dec. 21, 2018

(65) Prior Publication Data

US 2019/0206195 A1 Jul. 4, 2019

Related U.S. Application Data

(60) Provisional application No. 62/611,169, filed on Dec. 28, 2017.

(51) Int. Cl.
*G07F 17/32* (2006.01)

(52) U.S. Cl.
CPC ..... *G07F 17/3297* (2013.01); *G07F 17/3213* (2013.01); *G07F 17/3244* (2013.01); *G07F 17/3262* (2013.01)

(58) Field of Classification Search
None
See application file for complete search history.

(56) References Cited

U.S. PATENT DOCUMENTS

| | | | | |
|---|---|---|---|---|
| 9,318,000 | B1 * | 4/2016 | Allen | G07F 17/3255 |
| 2013/0079123 | A1 * | 3/2013 | Nicely | G07F 17/3225 463/26 |
| 2014/0221083 | A1 * | 8/2014 | Okada | G07F 17/3244 463/25 |

* cited by examiner

*Primary Examiner* — Lawrence S Galka
(74) *Attorney, Agent, or Firm* — EIP US LLP

(57) ABSTRACT

An improved coin pusher machine includes at least one player station. The at least one player station includes at least one memory device and processor, a pusher field configured to hold a plurality of tokens, a win slot configured to accept tokens that fall from the pusher field, and omitting any lose slot. The at least one player station includes a pusher mechanism configured to move in a reciprocating motion, a token launching mechanism configured to launch tokens onto the pusher field, and a token counter configured to count a number or value of tokens that fall into the win slot. The processor is configured to calculate a total value, including a base win value and a feature win value, of tokens falling into the win slot from the pusher field, and cause an indication associated with a game cycle to be transmitted to an external host computer.

20 Claims, 10 Drawing Sheets

COIN PUSHER CASINO GAME

CROSS-REFERENCE TO RELATED APPLICATIONS

This application claims the benefit of U.S. Provisional Application No. 62/611,169, filed Dec. 28, 2017. The above-referenced patent application is incorporated by reference in its entirety.

FIELD OF THE DISCLOSURE

The present disclosure relates to improvements to coin pusher games that comply with gambling regulations and casino requirements.

BACKGROUND

Description of the Related Technology

Casino gambling is a highly regulated industry. Casino gambling machines are typically required, by regulation, to meet minimum and maximum verifiable payback percentages, typically between 75% and 99% of money wagered. Such gambling machines are also typically required not to be susceptible to cheating. Gambling machines typically require testing and approval as to such payback percentages and immunity to cheating prior to commercial placement.

In the past, the nature of conventional coin pusher games, where coins or tokens are placed within a token field and a pusher mechanism pushes placed coins along the token field and into one of a "win" slot or a "lose" slot, have been susceptible to cheating by both players and operators, and so have not been able to meet compliance for the above-described minimum and maximum verifiable payback percentages or cheating immunity, rendering them commercially unexploitable in regulated casino environments.

Accordingly, there is a need for improved coin pusher casino games that allow verifiable payback percentages within predetermined ranges to be determined and/or that provide immunity against and/or detection of any occurrences of cheating.

SUMMARY

The present disclosure teaches aspects of improved coin pusher casino games that allow verifiable payback percentages within predetermined ranges to be determined and/or that provide immunity against and/or detection of any occurrences of cheating.

In some embodiments, a coin pusher machine is provided. The coin pusher machine includes at least one memory device. The coin pusher machine includes at least one game control processor in communication with at least the at least one memory device and configured to be in communication with at least one external host computer. The coin pusher machine includes a video display. The coin pusher machine includes a speaker. The coin pusher machine includes a sensor configured to detect shaking of the coin pusher machine. The coin pusher machine includes at least one player station. The coin pusher machine includes a controller configured to communicatively couple at least one of the at least one video display, the at least one speaker, the additional peripheral devices, and the at least one player station to the at least one game control processor. Each of the at least one player station includes at least one player station memory device. Each of the at least one player station includes at least one processor in communication with at least the at least one player station memory device. Each of the at least one player station includes a bill and/or ticket acceptor configured to receive at least one of monetary currency or a ticket from a player. Each of the at least one player station includes a ticket printer configured to print a ticket indicating a monetary currency value. Each of the at least one player station includes a player tracking peripheral configured to record the play of the player. Each of the at least one player station includes a speaker. Each of the at least one player station includes a video display configured to at least display a credit count available to the player. Each of the at least one player station includes an input device comprising at least one of a help button, a call button, a shoot token button, a take win button, and a cash out button. Each of the at least one player station includes a pusher field having a horizontal surface configured to hold a plurality of tokens, a win slot configured to accept tokens that fall from the pusher field, and no lose slot. Each of the at least one player station includes a pusher mechanism configured to move in a reciprocating, back-and-forth motion across a portion of the horizontal surface of the pusher field. A top surface of the pusher mechanism further forming an upper pusher field. Each of the at least one player station includes a token launching mechanism configured to launch an additional token onto the pusher field. Each of the at least one player station includes a token counter configured to count at least one of a number or value of tokens that fall into the win slot. The at least one processor is configured to receive an indication of monetary currency input by the player from the bill and/or ticket acceptor. The at least one processor is configured to cause the additional token to be launched onto the pusher field based on the shoot token button being pressed. The at least one processor is configured to receive an indication of a number of tokens falling into the win slot from the pusher field. The at least one processor is configured to calculate a total value corresponding to the number of tokens falling into the win slot from the pusher field. The total value includes a base win value that is a first percentage of a credit value required to put a token into play on the pusher field, and a feature win value that is a second percentage of the credit value required to put the token into play on the pusher field. The second percentage is determined based on one or more events occurring during play. The at least one processor is configured to cause the credit count on the video display to increment by the total value. The at least one processor is configured to cause an indication associated with the number of tokens falling into the win slot from the pusher field, or the corresponding total value, for a game cycle to be transmitted to the external host computer. The game cycle is defined as beginning when the pusher mechanism is oriented in a predetermined position and ending when the pusher mechanism first returns to the predetermined position after at least one token is introduced to the pusher field during the game cycle. Alternatively, the game cycle is defined as beginning at an end of an immediately previous game cycle and ending at an expiration of a predetermined interval of time during which at least one token is first introduced to the pusher field by the player after a start of the game cycle. Alternatively, the game cycle is defined as beginning at the end of the immediately previous game cycle and ending upon introduction of a predetermined number of tokens to the pusher field by the player. Alternatively, the game cycle is defined as beginning at the end of the immediately previous game cycle and ending when the token counter completes a count of tokens that have fallen into the win slot at substantially a same time and after at least one token is introduced to the pusher field by the player during the game cycle. Alternatively, the game cycle is defined as beginning at the end of the immediately previous game cycle and ending when a predetermined number of tokens fall into the win slot during the game cycle. Alternatively, the game cycle is defined as beginning at the end of the immediately previous game cycle and ending when the player presses the take win button. Alternatively, the game cycle is defined as beginning when the player inserts the monetary currency or the ticket into the bill and/or ticket acceptor and ending when the player presses the cash out button.

Figure 1:
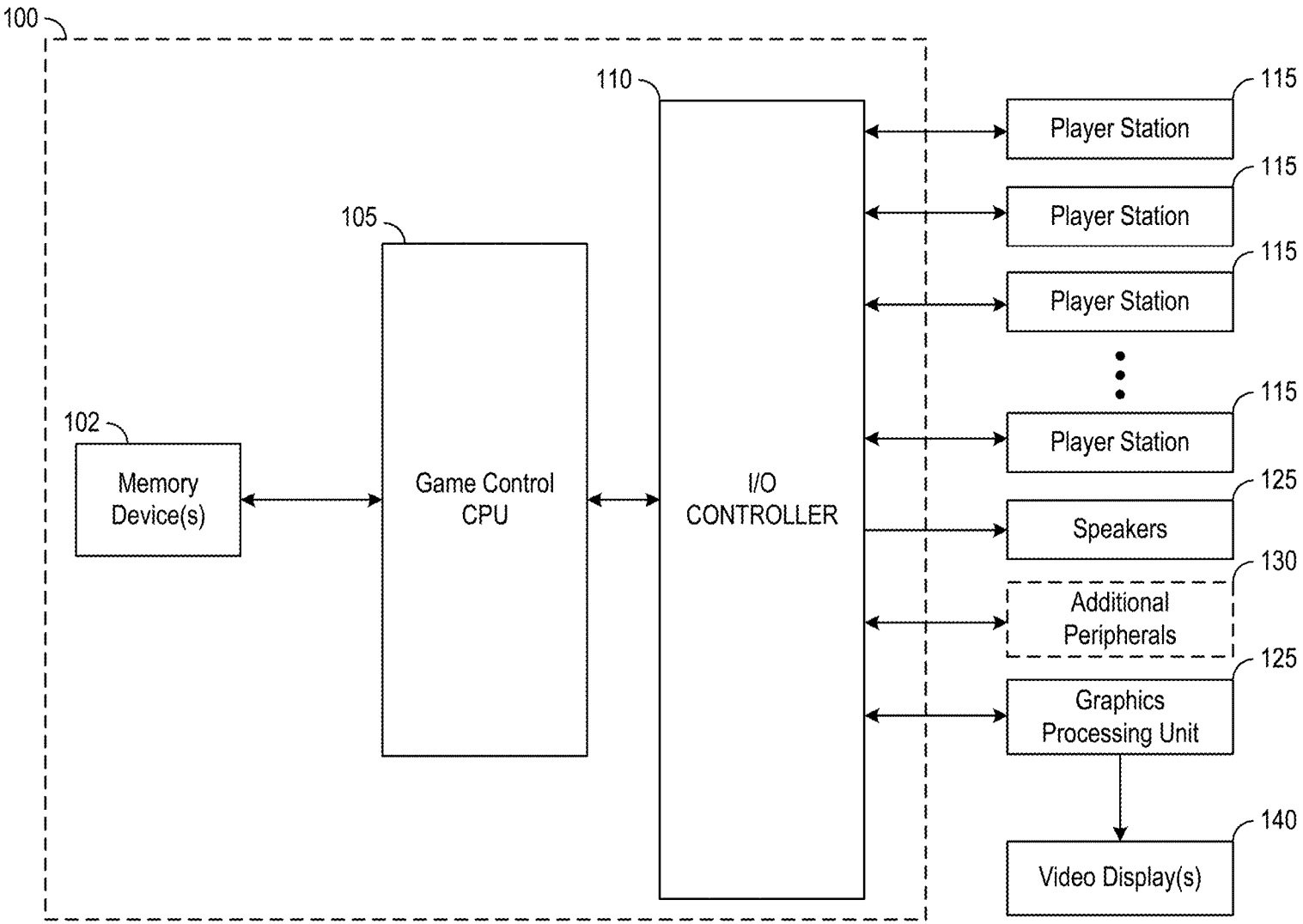
FIG. 1 is a block diagram of an improved coin pusher machine, according to some example embodiments.

Throughout the drawings, identical reference numbers designate similar, but not necessarily identical, elements. The figures are not necessarily to scale, and the size of some parts may be exaggerated to more clearly illustrate the example shown. Moreover, the drawings provide examples consistent with the description; however, the description is not limited to the examples provided in the drawings.

DETAILED DESCRIPTION

Casinos and other game operators want to feel comfortable that any device placed on the gambling floor will have a relatively predictable payback percentage over a period of time. Such casinos and other gaming operators also request the ability to track customer play and payback percentages in real-time or near real-time. This tracking ability allows reporting obligations related to player win and/or house hold to be met, allows immediate detection of abnormalities that may indicate cheating and/or machine malfunction, and allows monitoring of player tracking for player incentive and/or promotional purposes.

On the other hand, players want games to be quickly and easily understandable. For example, if players are going to invest money in a game, they don't want to have to learn complicated rules of play. Players also want to know that they have the potential to win periodically and that such periodic wins may be for a meaningful amount, since highly volatile games do not lend themselves to continuous play as players may go through long betting stretches without winning. Features such as secondary and/or bonus game play may provide both periodic winning and limited increased volatility, providing the possibility of larger wins. In addition, players have recently displayed an increased preference for games having a sufficiently interactive experience. The present disclosure for improved coin pusher machines, through various embodiments, provides one or more of these advantages to players and/or casino operators.

FIG. 1 is a block diagram of an improved coin pusher machine, according to some example embodiments. Arrowed lines are shown to generally illustrate the contemplated flow of communications between components.

It is contemplated that an improved coin pusher machine may have at least one secure area 100 to house sensitive components. While FIG. 1 illustrates several components within secure area 100, it is contemplated that additional components can be located within secure area 100 or that additional secure areas can be associated with the improved coin pusher machine. In FIG. 1, at least one game controller memory device 102 is in communication with a game control central processing unit (CPU) 105. Game Control CPU 105 can perform arithmetic and logical operations, and also extract instructions from game controller memory device(s) 102 and decode and execute them. Game control CPU 105 may comprise at least one processor. Alternatively, it is contemplated that instead of CPU 105, an array processor or vector processor having multiple parallel computing elements, which utilizes a distributed computing model, may be used to perform such arithmetic and logical operations. The game control CPU 105 may also be referred to as a game controller herein.

Game controller memory device(s) 102 can include one or more distinct types of memory devices, such as random-access memory (RAM) or dynamic RAM (DRAM), which can include non-volatile RAM (NVRAM), magnetic RAM (MRAM), ferroelectric RAM (FeRAM) and other forms as commonly understood in the computing industry. In some embodiments, the game controller memory device(s) 102 includes read only memory (ROM), which may, for example, store regulatory-sensitive instructions for the improved coin pusher machine. In some embodiments, the game controller memory device(s) 102 includes flash memory and/or EEPROM (electrically erasable programmable read only memory). Any other suitable magnetic, optical and/or semiconductor memory may operate in conjunction with improved coin pusher machines disclosed herein.

In some embodiments, game controller memory device(s) 102 store program code that is executable by game control CPU 105. Game controller memory device(s) 102 may also store operating data, such as a random number generator (RNG), game instructions, event data, display files, game history data, and other such data and instructions that allow for a gaming device to properly function in a regulated environment.

Game Control CPU 105 is communicatively connected to at least one input/output controller 110 which operates as an electrical interface between game control CPU 105 and access stations and various peripherals of the improved coin pusher machine. FIG. 1 further illustrates communicating with a plurality of player stations 115. In one embodiment, player stations 115 are the primary mechanism for the placement and settlement of wagers on the improved coin pusher machine.

FIG. 1 also illustrates other contemplated peripherals, including speakers 125, and other additional peripherals 130. In some embodiments, additional peripherals 130 may include one or more sensors configured to detect shakes and/or impacts of the improved coin pusher machine, which may be utilized to determine related game faults and/or cheating. Also illustrated is a graphic processing unit (GPU) 135, which works in coordination with game control CPU 105 to control video display(s) 140 contemplated herein, and causes them to display various aspects of a game.

Figure 2:
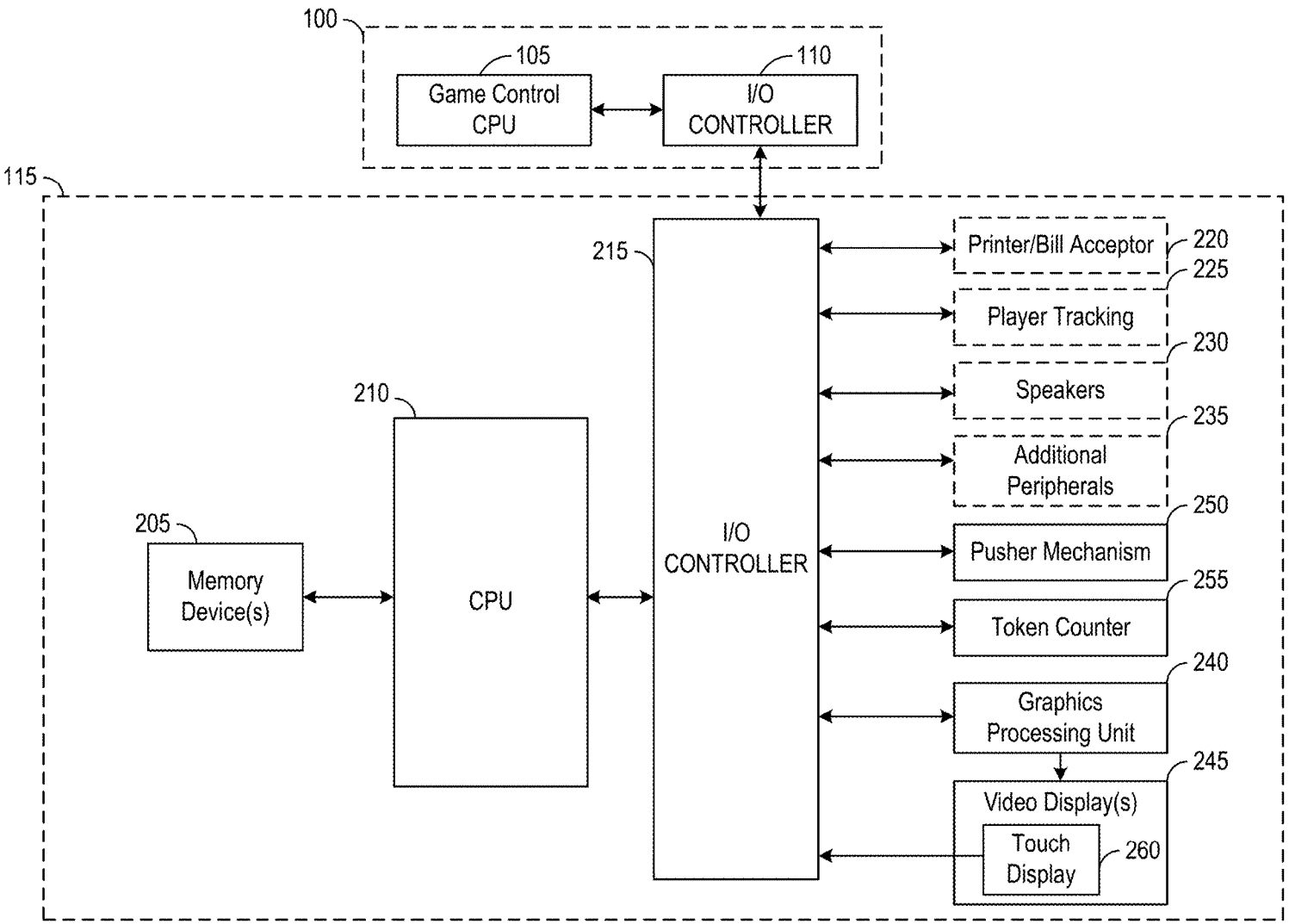
FIG. 2 is a block diagram of a player station of the improved coin pusher machine of FIG. 1, according to some example embodiments.

FIG. 2 is a block diagram of one of player stations 115 of the improved coin pusher machine of FIG. 1, according to some example embodiments. In some embodiments, at least one player station memory device 205 is in communication with a player station CPU 210. Player station CPU 210 can perform arithmetic and logical operations, and also extract instructions from player station memory device(s) 205 and decode and execute them. Player station CPU 210 may comprise at least one processor. Alternatively, it is contemplated that instead of player station CPU 210, an array processor or vector processor has multiple parallel computing elements, which utilizes a distributed computing model, to perform such arithmetic and logical operations. The player station CPU 210 may also be referred to as a player station controller herein.

Player station memory device(s) 205 can include one or more distinct types of memory devices, such as random-access memory (RAM) or dynamic RAM (DRAM), which can include non-volatile RAM (NVRAM), magnetic RAM (MRAM), ferroelectric RAM (FeRAM) and other forms as commonly understood in the computing industry. In one embodiment, the player station memory device(s) 205 include read only memory (ROM), which may, for example, store regulatory-sensitive instructions for the improved coin pusher machine. In one embodiment, the player station memory device(s) 205 include flash memory and/or EEPROM (electrically erasable programmable read only memory). Any other suitable magnetic, optical and/or semiconductor memory may operate in conjunction with player station 115.

In some embodiments, player station memory device(s) 205 store program code that is executable by player station CPU 210. Player station memory device(s) 205 may also store operating data, such as an RNG, game instructions, event data, display files, game history data, and other such data and instructions that allow for a gaming device to properly function in a regulated environment.

Player station CPU 210 is communicatively connected to at least one input/output controller 215, which operates as an electrical interface between player station CPU 210 and the game control CPU 105 via the I/O controller 110, and various peripherals of player station 115. FIG. 2 further illustrates communicating with a plurality of peripherals, such as a printer/bill acceptor 220. Printer/bill acceptor 220 can provide numerous benefits to casinos, including improving security as then all wagers and payouts can be tracked electronically.

FIG. 2 also illustrates the contemplated inclusion of a player tracking peripheral 225, which automates tracking of player bets, thereby supporting a casino's player tracking program. In the current embodiment, by allowing players to immediately associate their play with their player tracking account, for example by inserting their player tracking card into the player tracking peripheral 225, they are able to be accurately monitored. This can lead to both reduced costs for casinos, as they will only provide awards to players who actually meet their award criteria, and increased enjoyment by players, as their level of play will accurately be recorded, which can lead to increased awards.

Figure 5:
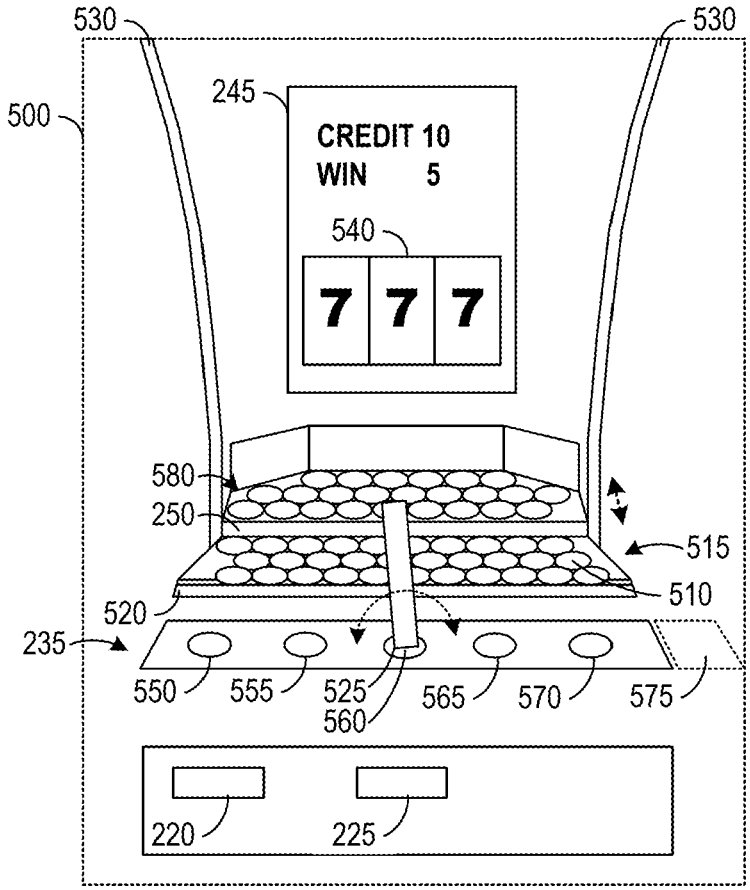
FIG. 5 is a perspective view of at least a portion of a player station of the improved coin pusher machine of FIG. 4, according to some example embodiments.
Figure 6A:
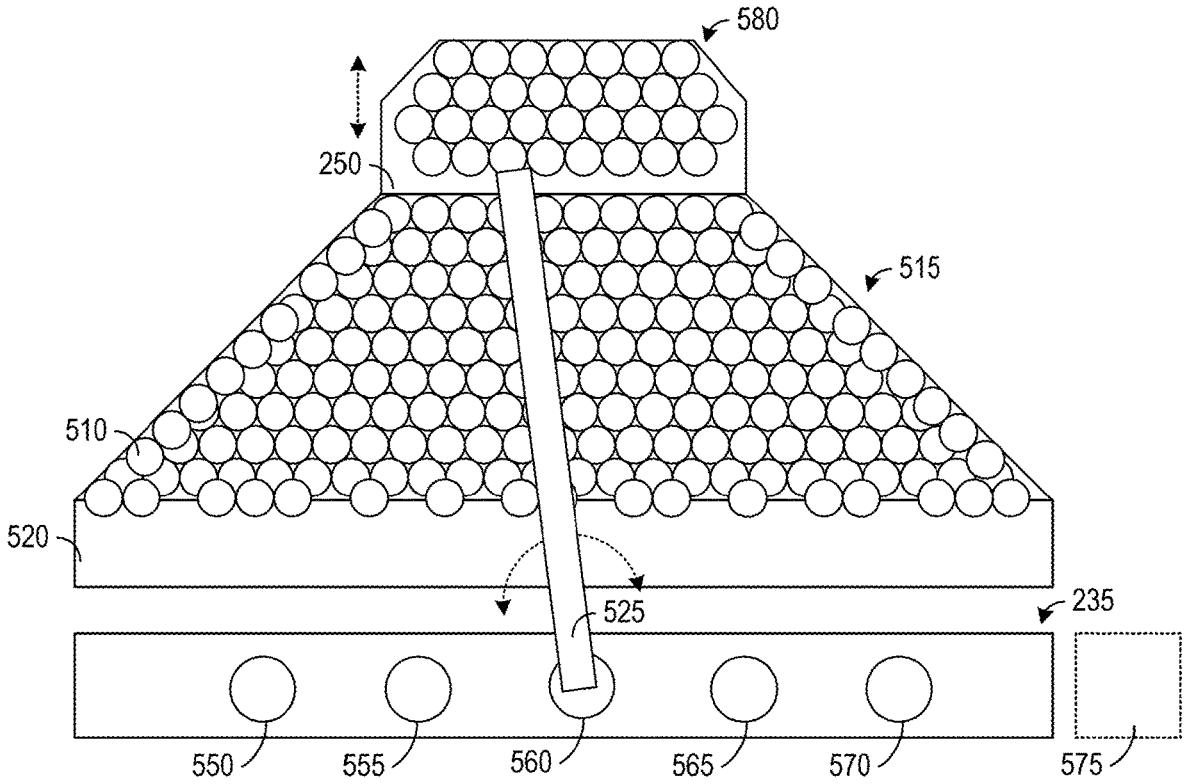
FIG. 6A is a top view of at least a portion of a player station of an improved coin pusher machine, according to some example embodiments.
Figure 6B:
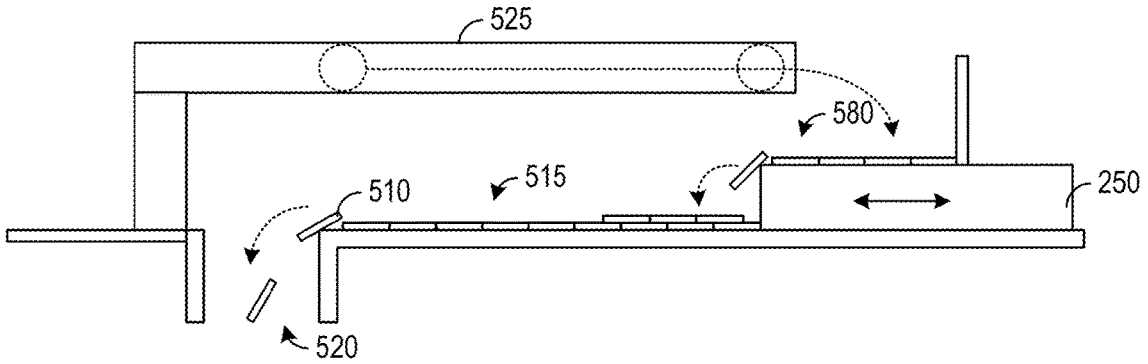
FIG. 6B is a side view of at least a portion of a player station of an improved coin pusher machine, according to some example embodiments.

FIG. 2 also illustrates a pusher mechanism 250 configured to generate reciprocating motion that pushes tokens, coins and/or chips brought into play on a pusher field (see FIGS. 5, 6A and 6B). In some embodiments, pusher mechanism 250 may be further configured to communicate information about its current, past, or predicted future position at a particular time instant to I/O controller 215, which, in some embodiments, may be utilized in determining and/or tracking betting cycles (e.g., start and/or stop instants of one or more temporally distinct or temporally overlapping betting cycles). In some other embodiments, such pusher position information may alternatively or additionally be tracked and/or determined by one or more of CPU 210 and/or game control CPU 105 based on a known, predetermined, or calculated speed and/or initial position of pusher mechanism 250.

FIG. 2 also illustrates a token counter 255 configured to count and/or track tokens, coins or chips that fall into a "win" slot (see FIGS. 5, 6A and 6B). In some embodiments, token counter 255 may comprise a mechanical hopper that physically counts a number and/or associated value of tokens, coins or chips falling into such a "win" slot. In other embodiments, token counter 255 may be configured to detect different kinds and/or size of tokens, for example, bonus or bonus game-causing tokens. In some other embodiments, token counter 255 may be configured to sense a location device, such as an RFID tag, a Bluetooth, a near-field communication (NFC), a WiFi, and/or other short-range or medium-range communication device disposed within the tokens, coins, or chips that identify a value associated therewith. Token counter 255 may be configured to communicate a count, a value, a type or size, and/or a time that one or more tokens, coins or chips fall into such a "win" slot to CPU 210 and/or with game control CPU 105 via I/O controller 215. However, the present disclosure is not so limited and any method of counting or tracking tokens, coins or chips falling into such a "win" slot are contemplated.

FIG. 2 also illustrates other contemplated peripherals, including speakers 230, and other additional peripherals 235 such as a video camera (not shown) configured to record a player's play as video. Also illustrated is a graphic processing unit (GPU) 240, which works in coordination with player station CPU 210 to control video display(s) 245 of player station 115, and causes them to display various aspects of a graphical user interface (GUI) for the improved coin pusher machine. It is further contemplated that, in some embodiments, the video display(s) 245 include a touch display 260, also referred to as a touchscreen, which is configured to receive various inputs from a player. As illustrated in FIG. 2, it is contemplated that touch display 260 is configured to communicate back to player station CPU 210 via I/O controller 215. In one embodiment, touch display 260 would allow a player to touch portions of the screen in order to input selections or other commands.

Figure 3A:
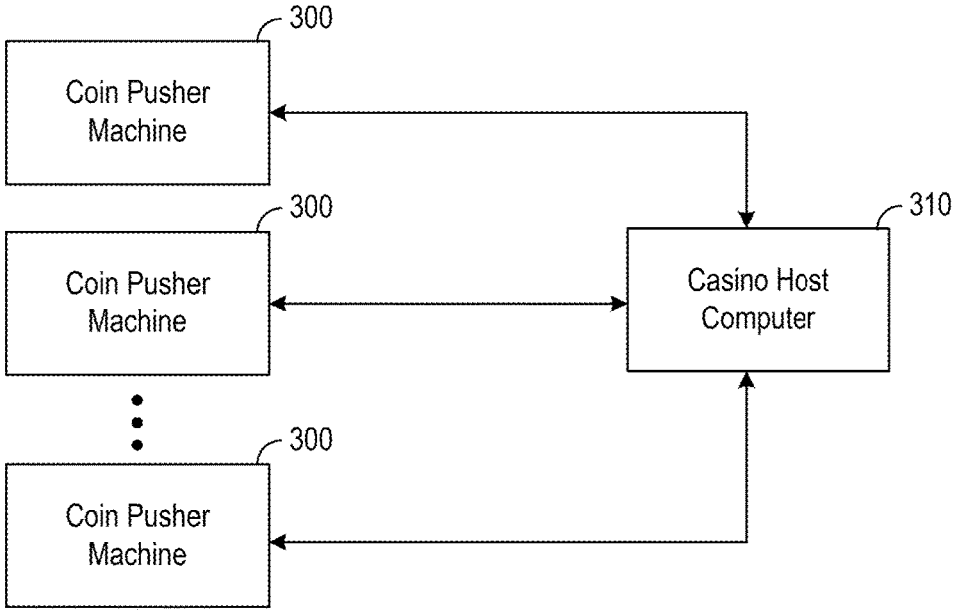
FIG. 3A is a block diagram of a plurality of improved coin pusher machines in communication with a casino host computer, according to some example embodiments.

FIG. 3A is a block diagram of a plurality of improved coin pusher machines 300 in communication with a casino host computer 310, according to some example embodiments. Each coin pusher machine 300 may correspond to a coin pusher machine as described in connection with any figure herein. As illustrated, each coin pusher machine 300 may be communicatively connected to casino host computer 310. Casino host computer 310 may comprise at least one processor. Alternatively, it is contemplated that casino host computer 310 comprise an array processor, vector processor, or a plurality of processors having multiple parallel computing elements, which utilizes a distributed computing model, may be used to perform such arithmetic and logical operations.

Figure 3B:
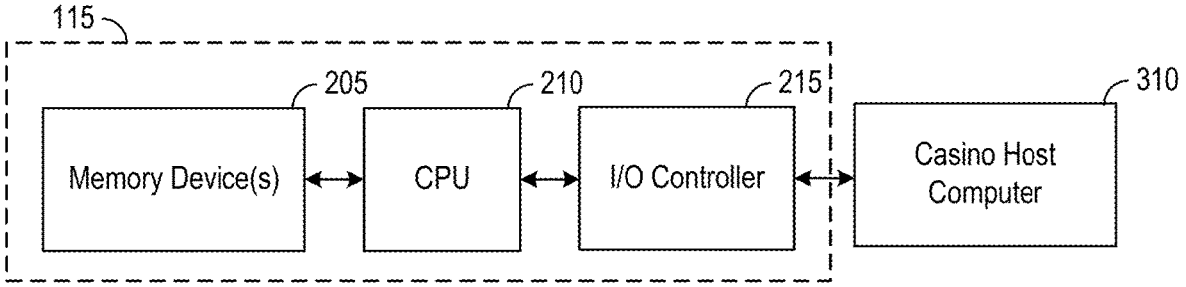
FIG. 3B is a block diagram of a player station, as previously described in connection with FIGS. 1 and 2, in communication with a casino host computer, according to some embodiments.

FIG. 3B is a block diagram of a player station 115, as previously described in connection with FIGS. 1 and 2, in communication with casino host computer 310, according to some embodiments. As illustrated, in some embodiments, each player station 115 may be communicatively connected to casino host computer 310 and may be configured to communicate with casino host computer 310 independently of other player stations 115.

Casino host computer 310 may be configured to monitor financial information related to each coin pusher machine 300 or player station 115 and/or one or more states of each coin pusher machine 300 or player station 115 (e.g., secure area 100 of FIG. 1 being open and/or closed) in real-time or substantially in real-time. Casino host computer 310 may be further configured to perform and/or monitor various other security and/or money management tasks as desired and/or required by a casino and/or by any gambling regulations. Accordingly, casino and/or regulatory agency personnel may be able to access notifications and/or reports of monetary and/or security-related functionality history of each of coin pusher machines 300 from a central location.

Figure 4:
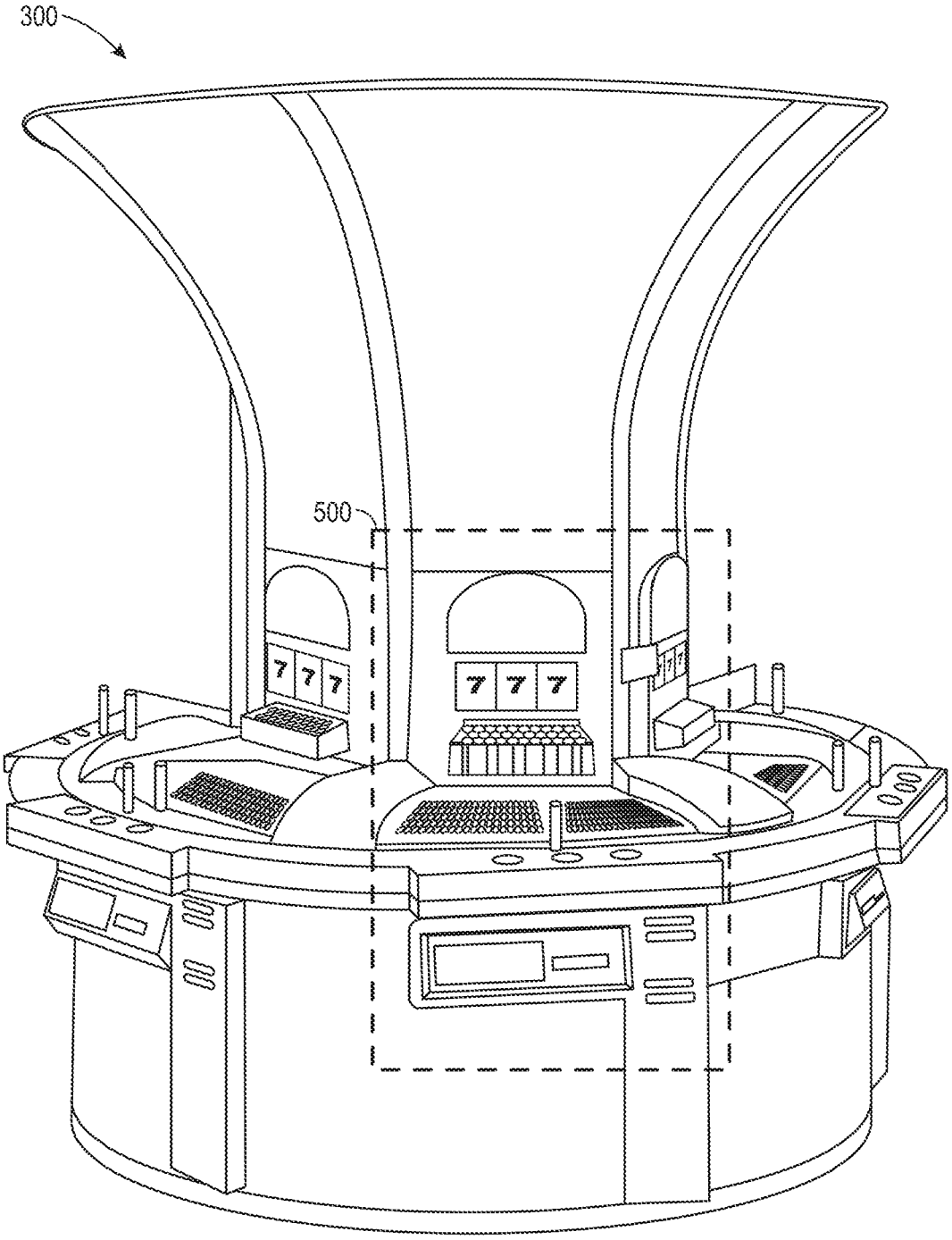
FIG. 4 is a perspective view of an improved coin pusher machine, according to some example embodiments.

FIG. 4 is a perspective view of improved coin pusher machine 300, according to some example embodiments Improved coin pusher machine 300 may comprise a plurality of individual player stations, although it is contemplated that improved coin pusher machine may only include a single player station. For example, coin pusher machine 300 is illustrated as having six player stations, although any number of player stations are contemplated. Coin pusher machine 300 may correspond to the coin pusher machine described in connection with FIGS. 1, 3A and 3B and each player station may correspond to player station 115, as previously described in connection with FIGS. 1 and 2. Each player station has its own pusher field and may institute its own game protocol, which may adjust the parameters of player wins and/or payouts (e.g., added slot machine functionality via, for example, a display screen, see FIGS. 1, 2 and 5). In some embodiments, coin pusher machine 300 may institute a community element where play and/or payouts of one player station are influenced by one or more parameters of play and/or payouts from another player station in the same coin pusher machine or in a different coin pusher machine. For example, a progressive game and/or bonus may be made available that takes into account prior and/or contemporaneous play of the same or another coin pusher machine player station.

A representative player station will now be described in more detail in connection with FIGS. 5, 6A and 6B. FIG. 5 illustrates a perspective view of at least a portion 500 of a player station of improved coin pusher machine 300 of FIG. 4, according to some example embodiments, while FIGS. 6A and 6B illustrate top and side views, respectively. of portion 500 of player station 115 of improved coin pusher machine 300, according to some example embodiments.

In some embodiments, each player station 115 may comprise printer/bill acceptor 220. In some examples, printer/bill acceptor 220 is configured to accept tangible mediums of currency, such as physical/paper bills and tickets. In some other embodiments, printer/bill acceptor 220 may comprise multiple components, such as separate currency acceptor and printer. In such embodiments, the currency acceptor may be a coin acceptor that accepts coins. In yet other embodiments, improved coin pusher machine 300 includes more than one currency acceptor, such as one for coins, one for paper bills, and/or one for tickets. In another embodiment, printer/bill acceptor 220 can accept multiple denominations of currency, or even currencies from multiple countries. In still another embodiment, printer/bill acceptor 220 can accept a ticket or similar physical indicium that is distributed by a casino or another gaming machine, which indicates an amount of currency available for wagering. In a further embodiment, printer/bill acceptor 220 can accept credit cards, debit cards, prepaid cards, or other instruments to initiate an electronic funds transfer. It is also contemplated that instead of, or in addition to, a printer/bill acceptor 220, the improved coin pusher machine 300 provides another means to allow a player to access money in order to wager on a play of the game. For example, the player may enter a personal identification number (PIN) in order to access an account they have, either with a bank or the casino itself, and upon entering the PIN and other information, certain amount of funds are transferred to the player station 115 or otherwise allowed to be wagered in relation to improved coin pusher machine 300. In another embodiment, printer/bill acceptor 220 is configured to interact with a radio frequency identification (RFID), a Bluetooth, a near-field communication (NFC), a WiFi, and/or other short-range or medium-range communication device which can transmit financial information short and/or medium distances, for example a bracelet, smart watch, smart phone, or other similar devices.

Player station 115 is also shown with a player tracking device 225. In some examples, player tracking device 225 includes a player tracking card reader, and a player information display. It is contemplated that such a player information display can be utilized to communicate with the player. It is contemplated that such player information display can be a liquid crystal display (LCD), a plasma display, an electroluminescent (EL) display, an organic light emitting diode (OLED) display, an LED dot matrix type of display, or can be any other type of display suitable for smaller displays. It is contemplated that player tracking device 225 may be visibly distinct or visually integrated with a portion of a video display (e.g., video display 245 and possibly also an associated touch display 260) in order to interact with a player. In practice, a player makes his or her identity known to player tracking device 225, either actively by inserting a player tracking card into the player tracking card reader and/or entering a PIN into an associated keypad or a touch interface incorporated with the player information display, or passively by utilizing a location device, such as an RFID tag, a Bluetooth, a near-field communication (NFC), a WiFi, and/or other short-range or medium-range communication device which can transmit information short and/or medium distances, for example a bracelet, smart watch, smart phone, or other similar devices. Thereafter, player tracking device 225 communicates over a network with a casino tracking system (e.g., casino host computer 310) to track a player's play, and potentially offer awards or other services to the player, often through the same player tracking device 225. Player tracking device 225 can also display, via the player information display, player status information back to the player, or other information based on or otherwise related to a player's play history and/or status, including awards earned by a player. In some embodiments, player tracking device 225 may be configured to provide cashless gaming for a player. For example, monetary credit associated with the player may be tracked or stored by casino host computer 310 (see FIGS. 3A and 3B) and the player may begin or resume player with such monetary credit at a particular player station 115 of improved coin pusher machine 300. It is also contemplated that the networked player tracking device 225 can be utilized to offer other services to players, such as the ordering of drinks, or making promotional offers to a player, perhaps working in coordination with printer/bill acceptor 220 to do so.

Player station 115 may also include an input device, which may correspond to additional peripherals 235 of FIG. 2, which allows a player to input commands In some embodiments, input device 235 may comprise a touch or multi-touch screen and/or physical buttons. For example, input device 235 is illustrated as comprising a help button 550 configured to call a help screen on video display 245. Input device 235 is further illustrated as comprising a call button 555 configured to call an attendant, for example, to request a drink or other available service. Input device 235 is further illustrated as comprising a shoot token button 560 configured to launch a token, coin, or chip from a token launching mechanism 525, in an adjustable direction preferred by the player, to a pusher field 515 without touching the token, coin or chip. Input device 235 is further illustrated as comprising a take win button 565 configured to transfer accrued credits from a win meter to a credit meter, e.g., one or both of which may be displayed by video display 245. Input device 235 is further illustrated as comprising a cash out button 570 configured to pay out all accumulated credits via, for example, a ticket printed and supplied to the player via printer/bill acceptor 220.

Improved coin pusher machine 300 may also comprise integrated drink areas 575. It is contemplated that drink areas 575 should advantageously be placed close to player station 115, but should also be in an area where an accidental spill will not affect sensitive components of the improved coin pusher machine 300. Although integrated drink area 575 is shown on a right-hand side of player station 115, the present disclosure is not so limited and contemplates one or more integrated drink areas and/or locations to set ash trays etc. on either side, both sides, or any other location of player station 115.

Player station 115 may further comprise a pusher field 515 where tokens, coins, or chips 510 are launched from token launch mechanism 525 and accumulate. In some embodiments, player station 115 further includes an upper pusher field 580, in some embodiments, comprising a top surface of pusher mechanism 250, as shown in FIGS. 6A and 6B, such that tokens, coins, or chips 510 are initially launched from token launch mechanism 525 onto upper pusher field 580. In such embodiments, as pusher mechanism 250 moves away from "win" slot 520, a surface of upper pusher field 580 may retract such that tokens, coins or chips 510 may fall from upper pusher field 580 to pusher field 525.

As shown, in some embodiments, pusher field 515 does not include a "lose" slot, where tokens, coins and/or chips that fall in are considered the house edge, in contrast to prior coin pusher machines. Omission of such "lose" slots from improved coin pusher machine 300 may increase reliability because the uneven, random occurrence of tokens, coins and/or chips falling into such "lose" slots has previously been difficult to accurately predict as well as because such "lose" slots have previously been tampered with (e.g., blocked or increased in size) in order to illegally skew the payout in favor of the player or house, respectively.

Tokens, coins or chips 510 may comprise any combination of externally-recognized monetary coin currency (e.g., US quarter dollars), internal circulation metallic coins, internal circulation chips, or internal circulation chips having designated values set and honored by a particular casino or gaming establishment. Moreover, in some embodiments, player station 115 may comprise a closed system in which a player inserts cash or a ticket at cash in and receives a ticket disclosing a number of credits at cash out, and wherein the player is never in physical contact with any token, coin or chip 510 in play. Such a system may make it easier to control, define and/or assure a desired payback for player station 115.

Player station 115 further comprises a "win" slot 520 disposed along at least a portion of a perimeter of pusher field 515. "Win" slot 520 is configured to receive tokens, coins and/or chips 510 that are pushed off the edge of pusher field 515 by pusher mechanism 250, which is configured to move forward and backward in a cyclical reciprocating motion at an edge of pusher field 515 substantially opposite to "win" slot 520. Tokens, coins and/or chips 510 that fall into "win" slot 520 are credited to the player as winnings. Accordingly, player station 115 may further comprise token counter 255 (see FIG. 2) configured to identify tokens, coins and/or chips 510 that fall into "win" slot 520 and their values for crediting to the player.

Such wins may be displayed to the player via video display 245, which may be configured to display various information related to a player's gambling session, for example but not limited to total credits available to the player and a number of credits won on one or more previous game cycles.

In addition, some embodiments contemplate displaying a video slot machine reel 540 via video display 245. In some embodiments, video slot machine reel 540 may alternatively or additionally comprise a mechanical slot reel, a roulette wheel, a bingo board or any other apparatus, electronic, video, physical or mechanical, that offers the probability of one or more winning states from a plurality of possible states. Accordingly, any discussion of video slot machine reel 540 may equally apply to such alternative or additional embodiments. Various events may be generated by different stopped combinations displayed on video slot machine reel 540. For example, pay outs for qualifying stopped combinations displayed on video slot machine reel 540 may be paid to the player in any combination of ways, including but not limited to, paying out tokens, coins and/or chips 510 directly into pusher field 515, paying out tokens, coins and/or chips 510 directly to the player, crediting the player one or more credits, crediting the player with amenities other than tokens, coins and/or chips 510, or an external jackpot based on communication with another machine or computer, for example, casino host computer 310 (see FIGS. 3A and 3B).

The spinning of video slot machine reel 540 may be triggered by any combination of events occurring during play, including but not limited to one or a predetermined number or value of tokens, coins and/or chips 510 falling into "win" slot 520, or being brought into play on pusher field 515 or input to player station 115 by a player. By linking the triggering of a spin of video slot machine reel 540 to such events, rather than based on tokens, coins and/or chips 510 falling into some other slot than "win" slot 520, an increase in predictability of payouts may be obtained.

Player station 115 may further comprise lighting 530 configured to perform a predetermined sequence and/or pattern of colors, flashes, and the like to indicate a win, near miss, or the occurrence of any other event to the player.

Because all tokens, coins and/or chips 510 that are brought into play on pusher field 515 can only exit pusher field 515 through "win" slot 520, the long-term physical return to players (RTP) is 100%. If the value given to tokens, coins and/or chips 510 that fall into "win" slot 520 are 100% of the value required of the player to put them into play on pusher field 515, the long-term house edge for improved coin pusher machine 300 would be 0%.

Accordingly, in order to introduce a controllable, adjustable house edge and/or player payout (P/O), some embodiments contemplate setting a base win value for tokens, coins or chips 510 that fall into "win" slot 520 that is a predetermined percentage or portion of the credit value required to put that token, coin or chip 510 into play on pusher field 515, e.g., 50%. In some embodiments, tokens, coins and chips may each have a base win value that is the same predetermined percentage or portion of the value required to put those tokens, coins and chips into play on pusher field 515. For example, all tokens may have a base win value that is 50% of the value required to put those tokens into play, e.g., the player is credited for half of the value required to put a token into play for each token that falls into "win" slot 520. In such an example, establishing that tokens, coins or chips 510 falling into "win" slot 520 have a predetermined percentage or portion of the credit value required to put that token, coin or chip 510 into play on pusher field 515 may establish base RTP and base P/O at that predetermined percentage, e.g., 50%.

In some other embodiments, tokens, coins and chips may each have different base win values compared to the value required to put the tokens, coins and chips into play on pusher field 515. For example, all tokens may have a base win value that is 50% of the value required to put those tokens into play, while coins or chips having an external currency face value have another base win value, e.g., 100% of their face values, thus, avoiding players feeling cheated if a chip having a face value of $5 that falls into "win" slot 520 is credited to the player at a value of less than $5.

In some embodiments, the predetermined percentages for the base win value of a token, coin or chip 510 may be static. In other embodiments, the predetermined percentages for the base win value of a token, coin or chip 510 may be variable based on the occurrence of one or more events during play.

As described above, if the base win value for tokens, coins or chips 510 falling into "win" slot 520 are the only values credited to a player, RTP and P/O will be the predetermined percentage of the in-play value for the base win value. For some predetermined percentages, the absolute RTP and P/O to the player may be below regulation minimums.

Accordingly, in some embodiments, each token, coin or chip 510 falling into "win" slot 520 may be awarded the base win value plus a feature win value that is another predetermined percentage of the value required to put that token, coin or chip 510 into play. The predetermined percentage for the feature win value may be determined based on one or more events occurring during play. For example, for each token, coin or chip 510 that falls into "win" slot 520, an RNG may determine the feature win value percentage of the value required to put that token, coin or chip 510 into play within a predetermined range, e.g., 20-50%. For example, a base win value may be 50% and a randomly generated feature win value of 40% may be determined by a random number generator operating within game control CPU 105 or CPU 210 (see FIGS. 1 and 2) for a total win value of 90%. In some embodiments, feature win value may be determined such that the sum of base win value and feature win value of tokens, coins or chips 510 falling into "win" slot 520 over a predetermined period of time average out to a target percentage of the total value required to put those tokens, coins or chips 510 into play, e.g., 97%.

In yet other embodiments, the base win value and the feature win value for a particular token, coin or chip 510 falling into "win" slot 520 may both be varied based on one or more events occurring during play such that their sum, e.g., the total win value, is a target percentage on a per-token basis, as an average over a predetermined number of tokens, coins or chips 510 falling into "win" slot 520, or as an average over a predetermined period of time. For example, a token, coin or chip 510 falling into "win" slot 520 may be given a base win value of 50% and a feature win value of 30%, totaling 80%. In another example, a token, coin or chip 510 falling into "win" slot 520 may be given a base win value of 40% and a feature win value of 50%, totaling 90%.

In some embodiments, the occurrence of certain events may trigger a "bonus" game, which may provide an opportunity for a player to greatly increase their winnings. An example of such a "bonus" game may involve multi-level random determinations for an additional potential payout. For example, every $i^{th}$ token 510 that falls into "win" slot 520 may trigger a random determination, for example utilizing an RNG, as to whether to award a "bonus" game. Alternatively, for each token 510 that falls into "win" slot 520, a random determination, for example utilizing an RNG and having a 1/i probability of returning a triggering outcome, may be made as to whether to award the "bonus" game.

In some embodiments, the "bonus" game may comprise a reel spin of video slot machine reel 540, which itself has one or more potential winning stopping combinations having predetermined probabilities of occurrence and associated paybacks within a predetermined range (e.g., 0 to 500×, with "×" representing the wager associated with the play of the game). In some embodiments, the "bonus" game may comprise another game having a particular theme or storyline, presented on video display 245, that automatically awards a payback within such a predetermined range. In some embodiments, the "bonus" game may comprise an interactive game, presented on video display 245 for example, where the player is allowed to select one or more of a plurality of selections that will award paybacks within such a predetermined range that are unknown to the player until after selection. Such awarded paybacks may have values such that a total average payout of improved coin pusher machine 300 is within predetermined payback rates (e.g., 97-99%).

An example of the video slot machine reel "bonus" game may be as follows. Let us assume, in this example, that i is 10, that the predetermined probability of occurrence of a winning stopping combination is 1/25 and the payback value of the winning stopping combination is 100×. In such a scenario, the payback percentage for just the "bonus" game, which may be interpreted as a feature win value, would be $1/10 \times 1/25 \times 100 = 40\%$.

An example of the interactive "bonus" game may be as follows. Let us assume, in this example, that i is again 10, that the predetermined probability of occurrence of entry into the interactive "bonus" game is 1/25, and the interactive "bonus" game comprises displaying 20 boxes having predetermined payback values that are unknown to the player until after selection of a a particular box. The predetermined payback values may, together, have a total average value of 50×, with actual individual values ranging from 1× to 500×. Let us assume the player is prompted to select 5 of the 20 boxes and will be awarded the predetermined payback values associated with each of the 5 selected boxes, and that the 5 selected boxes have values of 1×, 5×, 10×, 50×, and 100×. In such a scenario, the "bonus" game would be presented, on average, once for every 250 tokens 510 that fall into "win" slot 520 and the payback percentage for just the "bonus" game, which may be interpreted as a feature win value, would be $\frac{1}{10}\times\frac{1}{25}\times(1+5+10+50+100)=66.4\%$.

In some embodiments, rather than every $i^{th}$ token triggering the "bonus" game, or every token having a 1/i probability of triggering the bonus game, certain designated chips or tokens may automatically trigger a "bonus" game when they fall into "win" slot 520. For example, such designated chips may have a different look, color, inscription, or other designation visible to the player or not visible to the player. In one embodiment, an expected rate of triggering the bonus is determined based on the number of bonus tokens included in the coin pusher game. For example, for every nine tokens 510, the coin pusher has a bonus token, so that on average, for every ten tokens that fall into "win" slot 520, one will be a bonus token. In another example, if multiple bonus tokens fall into "win" slot 520, the coin pusher game may provide multiple plays of the bonus game or a multiplier for a single play of the bonus game.

Defining Game Cycles

Because tokens, coins or chips may be continuously added to pusher field 515 and randomly fall into "win" slot 520 of one or more player stations 115 of the coin pusher machine, it is difficult to define a single game cycle in the same way as with slot machines, which have a clearly defined start of the game cycle (initiation of a reel spin predicated on a preselected wager amount) and a clearly defined end of the game cycle (stopping of the reel spin and payout of any winning reel combinations). However, defining a game cycle may be required for regulatory compliance with respect to at least P/O reporting. Accordingly, the present disclosure contemplates several protocols for defining a single game cycle by combining special characteristics of the operation of improved coin pusher machine 300, as will be described below in connection with FIGS. 7A-7G.

Utilizing one or more such game cycle definitions, improved coin pusher machine 300 may be configured to communicate information regarding each game cycle to casino host computer 310 (see FIGS. 3A and 3B), for example, the time a particular game cycle started, a time the game cycle ended, a value of any wager(s) made by a player during the game cycle, a value of any win(s) made by the player during the game cycle, and/or any statistic related to P/O, such as payout percentage, for example.

Figure 7A:
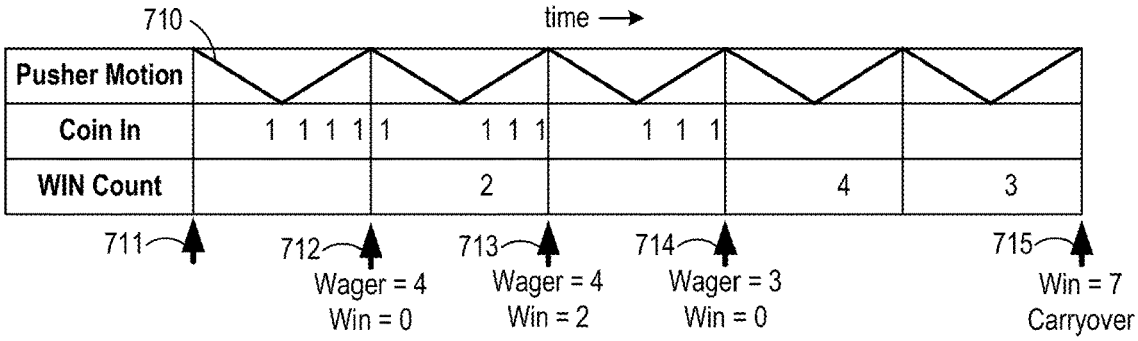
FIGS. 7A-7G illustrate relationships among pusher mechanism motion, wagers and win counts for varied methods of betting cycle accounting for an improved coin pusher machine, according to some embodiments.

FIG. 7A illustrates a relationship among pusher mechanism motion, wagers and win counts for a method of defining a game cycle for an improved coin pusher machine, according to some embodiments. In FIG. 7A, the reciprocating motion 710 of pusher mechanism 250 (see FIG. 2) is illustrated in a first row by line 710, with time extending from the left to the right of FIG. 7A. The middle row indicates timing of the introduction of tokens or coins 510 onto pusher field 515 by the player utilizing token launching mechanism 525 (see FIGS. 5, 6A and 6B). The bottom row indicates timing of tokens or coins 510 falling into "win" slot 520.

In FIG. 7A, the start and end of a game cycle is tied to cycles of reciprocating motion 710 of pusher mechanism 250. Specifically, a game cycle is defined as beginning when pusher mechanism 250 is oriented in a predetermined position in its reciprocating motion 710 and as ending when pusher mechanism 250 first returns to the predetermined position in its reciprocating motion 710 after at least one token, coin or chip 510 has been introduced to pusher field 515 during the game cycle.

For example, a first game cycle begins at 711, when pusher mechanism 250 is in a predetermined position in its reciprocating motion 710, in this example, when pusher mechanism 520 is fully retracted at its farthest distance from "win" slot 520 (see FIGS. 5, 6A and 6B). The first game cycle ends at 712, when pusher mechanism 250 has first returned to the predetermined position in its reciprocating motion 710 after at least one token, coin or chip 510 has been introduced to pusher field 515 during the first game cycle. As can be seen, four tokens were introduced during the first cycle of reciprocating motion 710 and zero tokens fell into "win" slot 520 during the first game cycle. Accordingly, the first game cycle would have four tokens wagered and zero tokens won.

A second game cycle begins at 712 and ends at 713, when pusher mechanism 250 has first returned to the predetermined position in its reciprocating motion 710 after at least one token, coin or chip 510 has been introduced to pusher field 515 during the second game cycle. As can be seen, four more tokens were introduced to pusher field 515 during the second cycle of reciprocating motion 710 and two tokens fell into "win" slot 520 during the second game cycle. Accordingly, the second game cycle would have four tokens wagered and two tokens won.

A third game cycle begins at 713 and ends at 714, when pusher mechanism 250 has first returned to the predetermined position in its reciprocating motion 710 after at least one token, coin or chip 510 has been introduced to pusher field 515 during the third game cycle. As can be seen, three more tokens were introduced during the third cycle of reciprocating motion 710 and zero tokens fell into "win" slot 520 during the third game cycle. Accordingly, the third game cycle would have three tokens wagered and zero tokens won.

A fourth game cycle begins at 714 and is not shown to end in the timeframe covered by FIG. 7A because no token, coin or chip 510 was introduced to pusher field 515 during any of the remaining cycles of reciprocating motion 710, even though seven tokens fell into "win" slot 520 during those remaining cycles of reciprocating motion 710. Accordingly, the seven tokens falling into "win" slot 520 after 714 will be carried over within the fourth game cycle, which will end when pusher mechanism 250 has first returned to the predetermined position in its reciprocating motion 710 after at least one token, coin or chip 510 has been introduced to pusher field 515 during the fourth game cycle.

Figure 7B:
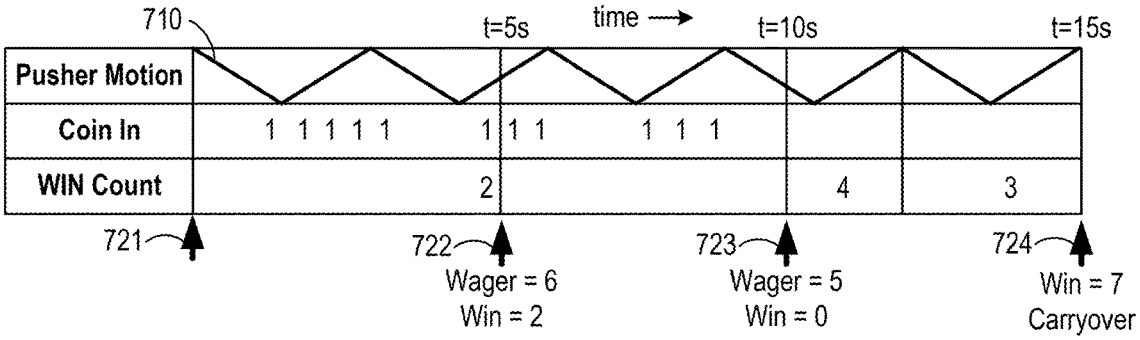

FIG. 7B illustrates a relationship among pusher mechanism motion 710, wagers and win counts for another method of defining a game cycle for an improved coin pusher machine, according to some embodiments.

In FIG. 7B, the start and end of a game cycle occur at integer multiples of a regular interval from one another. Specifically, each game cycle is defined to span integer multiples of a predetermined interval of time that is independent of, or not necessarily dependent on, motion 710, introduction of tokens, coins or chips 510 to pusher field 515 or tokens, coins or chips 510 falling into "win" slot 520. In other words, each game cycle is defined to end at the expiration of the first predetermined interval of time during which at least one token, coin or chip 510 has been introduced to pusher field 515, after a start of the game cycle.

For example, a first game cycle begins at 721. Although the beginning of this first game cycle is shown as arbitrary, it begins at the same instant an immediately previous game cycle ends and all subsequent game cycles begin at the same instant the immediately previous game cycle ends. In the example shown by FIG. 7B, the predetermined interval of time is five seconds, although the present disclosure is not so limited and any interval of time may be utilized. Thus, the first game cycle ends at 722, five seconds after the start of the first game cycle at 721. As can be seen, six tokens were introduced to pusher field 515 and two tokens fell into "win" slot 520 during the first game cycle. Accordingly, the first game cycle would have six tokens wagered and two tokens won.

A second game cycle begins at 722 and ends at 723, five seconds after the start of the second game cycle at 722. As can be seen, five more tokens were introduced to pusher field 515 and zero tokens fell into "win" slot 520 during the second game cycle. Accordingly, the second game cycle would have five tokens wagered and zero tokens won.

A third game cycle begins at 723 and is not shown to end in the timeframe covered by FIG. 7B, at 724, because, although five seconds have passed since the start of the third game cycle, at 723, no additional tokens were introduced to pusher field 515 between 723 and 724. Thus, the seven tokens that fell into "win" slot 520 between 723 and 724 during the third game cycle are carried over until the expiration of the next predetermined interval of time during which at least one token, coin or chip 510 has been introduced to pusher field 515 by the player.

Figure 7C:
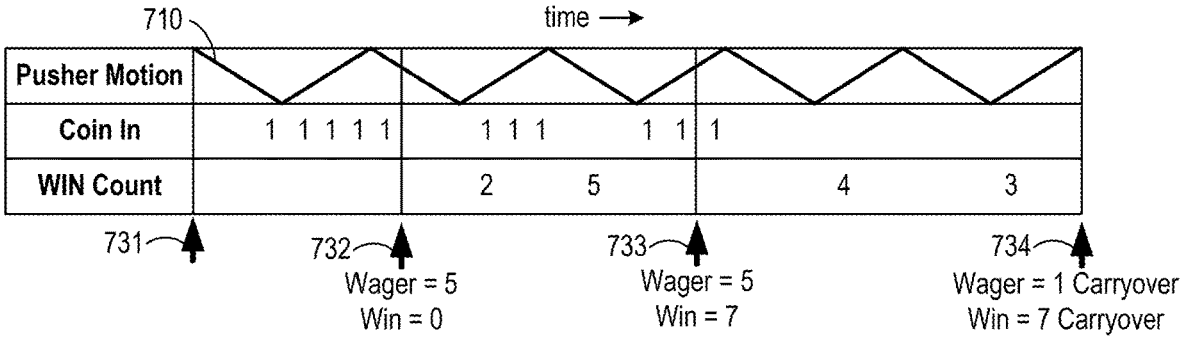

FIG. 7C illustrates a relationship among pusher mechanism motion 710, wagers and win counts for yet another method of defining a game cycle for an improved coin pusher machine, according to some embodiments.

In FIG. 7C, a game cycle is defined to end upon introduction of a predetermined number of tokens to pusher field 515 by the player after the start of the particular game cycle. Specifically, each game cycle is defined to span an indeterminate interval of time that depends on the introduction of tokens, coins or chips 510 to pusher field 515 by the player but not on motion 710 or tokens, coins or chips 510 falling into "win" slot 520 during the particular game cycle.

For example, a first game cycle begins at 731. Although the beginning of this first game cycle is shown as arbitrary, all subsequent game cycles will begin at the same instant the immediately previous game cycle ends. In the example shown by FIG. 7C, the predetermined total wager value is five tokens, although the present disclosure is not so limited and any number of tokens may be utilized. Thus, the first game cycle ends, at 732, upon introduction of five total tokens after the start of the first game cycle at 731. As can be seen, five tokens were introduced to pusher field 515 and zero tokens fell into "win" slot 520 during the first game cycle. Accordingly, the first game cycle would have five tokens wagered and zero tokens won.

A second game cycle begins at 732 and ends, at 733, upon introduction of five total tokens after the start 732 of the second game cycle. As can be seen, five more tokens were introduced to pusher field 515 and seven tokens fell into "win" slot 520 during the second game cycle. Accordingly, the second game cycle would have five tokens wagered and seven tokens won.

A third game cycle begins at 733 and is not shown to end in the timeframe covered by FIG. 7C because five total tokens were not introduced to pusher field 515 during the interval from 733 to 734, even though seven tokens fell into "win" slot 520 during that interval. Accordingly, the seven tokens falling into "win" slot 520 after 733 will be carried over within the third game cycle, which will end upon introduction of the fifth token to pusher field 515 by a player after the start 733 of the third game cycle. Accordingly, the portion of the third game cycle would carryover one token wagered and seven tokens won.

Figure 7D:
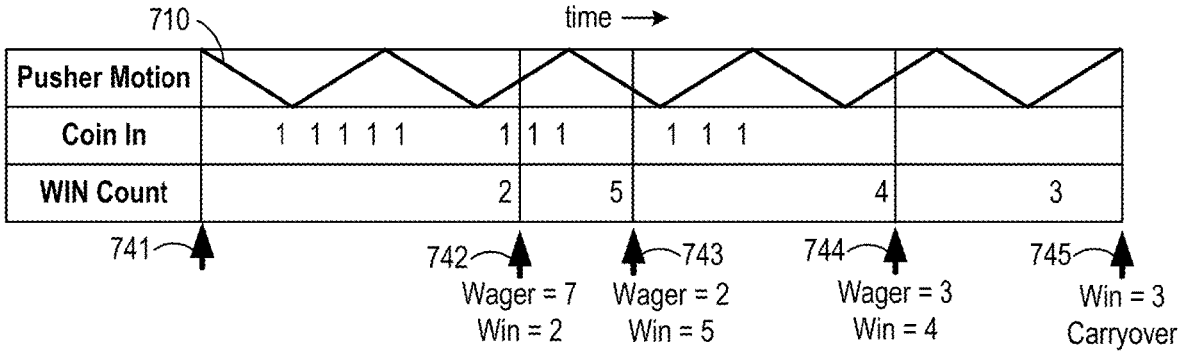

FIG. 7D illustrates a relationship among pusher mechanism motion 710, wagers and win counts for yet another method of defining a game cycle for an improved coin pusher machine, according to some embodiments.

In FIG. 7D, a game cycle is defined to end when a win count hopper (e.g., token counter 255 of FIG. 2) completes a count of tokens, coins or chips 510 that have fallen into "win" slot 520 at substantially a same time and after at least one token, coin or chip 510 has been introduced to pusher field 515 during the game cycle. Such a game cycle may start at a same instant that an immediately previous game cycle has ended according to the same definition. For example, pusher mechanism 525 pushes against tokens, coins and chips 510 lying on pusher field 515, most forcefully as pusher mechanism 525 approaches its nearest position to "win" slot 520 (denoted by the vertically lowest points of pusher motion 710 shown in FIG. 7D). Thus, if tokens, coins or chips 510 fall into "win" slot 520, they generally do so just as pusher mechanism 525 approaches or reaches its nearest position to "win" slot 520. Accordingly, tokens, coins or chips 510 from pusher field 515 will tend to fall into "win" slot 520 at times that coincide with pusher mechanism 525 approaching its nearest position to "win" slot 520. Therefore, "at substantially a same time", as it relates to the description of FIGS. 7A-7G may be considered to correspond to a short time interval from when pusher mechanism 525 is traveling toward "win" slot 520 to a predetermined time (e.g., 1 second) after pusher mechanism 525 has reached its nearest position to "win" slot 520 since once pusher mechanism 525 begins to travel in the opposite direction of "win" slot 520, it is not likely to push tokens, coins or chips 510 on pusher field 515 toward, and potentially into, "win" slot 520 until at least the next cycle of pusher mechanism motion 710.

For example, a first game cycle begins at 741. Although the beginning of this first game cycle is shown as arbitrary, it began at a same instant as an immediately previous game cycle and all subsequent game cycles will begin at the same instant the immediately previous game cycle ends. The first game cycle ends, at 742, when token counter 255 completes a count of tokens, coins or chips 510 that have fallen into "win" slot 520 at substantially a same time during the first game cycle and after at least one token, coin or chip 510 has been introduced to pusher field 515 by the player after a start of the game cycle. As can be seen, six tokens were introduced to pusher field 515 and two tokens fell into "win" slot 520 at substantially a same time during the first game cycle. Accordingly, the first game cycle would have six tokens wagered and two tokens won.

A second game cycle begins at 742 and ends, at 743, when token counter 255 completes a count of tokens, coins or chips 510 that have fallen into "win" slot 520 at substantially a same time and after at least one token, coin or chip 510 has been introduced to pusher field 515 by the player after a start of the game cycle. As can be seen, two more tokens were introduced to pusher field 515 and five tokens fell into "win" slot 520 at substantially the same time during the second game cycle. Accordingly, the second game cycle would have two tokens wagered and five tokens won.

A third game cycle begins at 743 and ends, at 744, when token counter 255 completes a count of tokens, coins or chips 510 that have fallen into "win" slot 520 at substantially a same time and after at least one token, coin or chip 510 has been introduced to pusher field 515 by the player after a start of the game cycle. As can be seen, three more tokens were introduced to pusher field 515 and four tokens fell into "win" slot 520 at substantially the same time during the third game cycle. Accordingly, the third game cycle would have three tokens wagered and four tokens won.

A fourth game cycle begins at 744 and is not shown to end during the timeframe illustrated by FIG. 7D, by 745. As can be seen, although three tokens fell into "win" slot 540 during the interval from 744 to 745, zero additional tokens were introduced to pusher field 515 after a start of the game cycle. Thus, the three tokens that fell into "win" slot 520 between 744 and 745 during the fourth game cycle are carried over until at least one token, coin or chip 510 has been introduced to pusher field 515 by the player and token counter 255 completes a subsequent count of tokens, coins or chips 510 that have fallen into "win" slot 520 at substantially a same time.

Figure 7E:
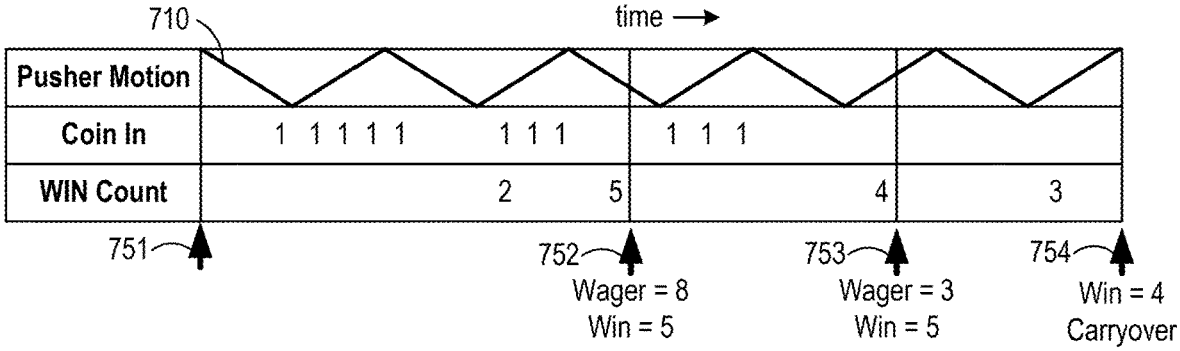

FIG. 7E illustrates a relationship among pusher mechanism motion 710, wagers and win counts for yet another method of defining a game cycle for an improved coin pusher machine, according to some embodiments.

In FIG. 7E, a game cycle is defined to end when at least a predetermined total win value accrues during a particular game cycle. Specifically, each game cycle is defined to span an indeterminate interval of time that depends on at least a predetermined number of tokens, coins or chips 510 from pusher field 515 accruing as a player win by falling into "win" slot 520 during the particular game cycle or by carryover from the immediately previous game cycle.

For example, a first game cycle begins at 751. Although the beginning of this first game cycle is shown as arbitrary, it begins at a same time instant that an immediately previous game cycle ends and all subsequent game cycles will begin at the same instant the immediately previous game cycle ends. In the example shown by FIG. 7E, the predetermined total win value is five tokens, although the present disclosure is not so limited and any number of tokens may be utilized. Thus, the first game cycle ends, at 752, when an integer multiple of five total tokens have accrued as a win during the first game cycle. As can be seen, eight tokens were introduced to pusher field 515 and seven tokens fell into "win" slot 520 during the first game cycle. However, since a game cycle is considered to end when an integer multiple of the predetermined total win value of five tokens is reached, the first game cycle would have eight tokens wagered and five tokens won, with the remainder of two won tokens being carried over to the immediately following game cycle. In conditions where more than an integer multiple of the predetermined total win value is reached in a single game cycle, e.g., more than 5, more than 10 tokens fall into "win" slot 520 at substantially a same time, only the tokens in excess of the integer multiple of the predetermined total win value are carried over and the integer multiple of the predetermined total win value are recorded as having occurred during that game cycle.

A second game cycle begins at 752 and ends, at 753, when an integer multiple of five total tokens have accrued as a win during the second game cycle. In this example, two won tokens from the first game cycle were carried over to the second game cycle, three more tokens were introduced to pusher field 515 and four more tokens fell into "win" slot 520 during the second game cycle, totaling six won tokens in the second game cycle. Thus, the second game cycle would have three tokens wagered and five tokens won, with the remainder of one won token being carried over to the immediately following game cycle.

A third game cycle begins at 753 and is not shown to end in the timeframe covered by FIG. 7E, by 754, because even though three additional tokens fell into "win" slot 520 between 753 and 754 and one won token was carried over from the second game cycle, the predetermined total win value of five tokens has not yet been reached as of 754. Accordingly, the three tokens falling into "win" slot 520 after 753 and the one won token carried over from the second game cycle, will both be carried over within the third game cycle, which will end upon at least one more token falling into "win" slot 520. Accordingly, the portion of the third game cycle would carryover the four won tokens.

Figure 7F:
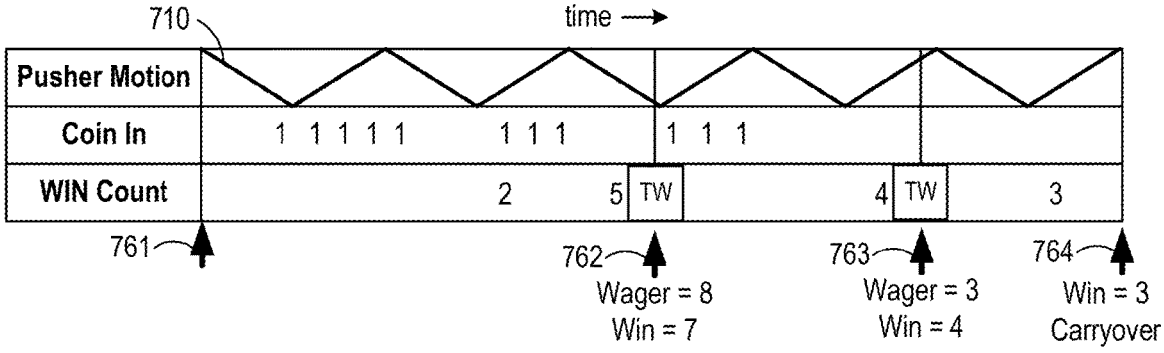

FIG. 7F illustrates a relationship among pusher mechanism motion 710, wagers and win counts for yet another method of defining a game cycle for an improved coin pusher machine, according to some embodiments.

In FIG. 7F, a game cycle is defined to end when a player presses take win button 565 (see FIGS. 5, 6A and 6B). As previously described, a player pressing take win button 565 transfers accrued credits from a win meter to a credit meter, e.g., one or both of which may be displayed by video display 245 (see FIGS. 2, 5, 6A and 6B). In such examples, pressing take win button 565 is not the same as "cashing out" because the credits accrued by the player are not "cashed out" from player station 115, but are, instead, transferred from a counter tracking the wins accrued since the last press of take win button 565 or since a last insertion of additional currency or credits to player station 115 by the player. Whereas pressing cash out button 570 would pay out all accumulated credits via, for example, a ticket printed and supplied to the player via printer/bill acceptor 220.

For example, a first game cycle begins at 761. Although the beginning of this first game cycle is shown as arbitrary, it begins at a same time instant that an immediately previous game cycle ends or, in the case of the player just arriving, upon loading of credits into player station 115 by the player. All subsequent game cycles will begin at the same instant the immediately previous game cycle ends.

The first game cycle ends at 762, when the player presses the take win button 565. As can be seen, eight tokens were introduced to pusher field 515 and seven tokens fell into "win" slot 520 during the first game cycle, prior to the player pressing the take win button 565. Accordingly, the first game cycle would have eight tokens wagered and 7 tokens won.

A second game cycle begins at 762 and ends, at 763, when the player presses the take win button 565 again. As can be seen, three tokens were introduced to pusher field 515 and four tokens fell into "win" slot 520 during the second game cycle, prior to the player pressing the take win button 565 again. Accordingly, the second game cycle would have three tokens wagered and four tokens won.

A third game cycle begins at 763 and is not shown to end in the timeframe covered by FIG. 7F, by 764, because the player has not yet pressed take win button 565 by 764. Accordingly, the three tokens falling into "win" slot 520 after 763 will be carried over within the third game cycle, which will end when the player presses take win button 565 again.

Figure 7G:
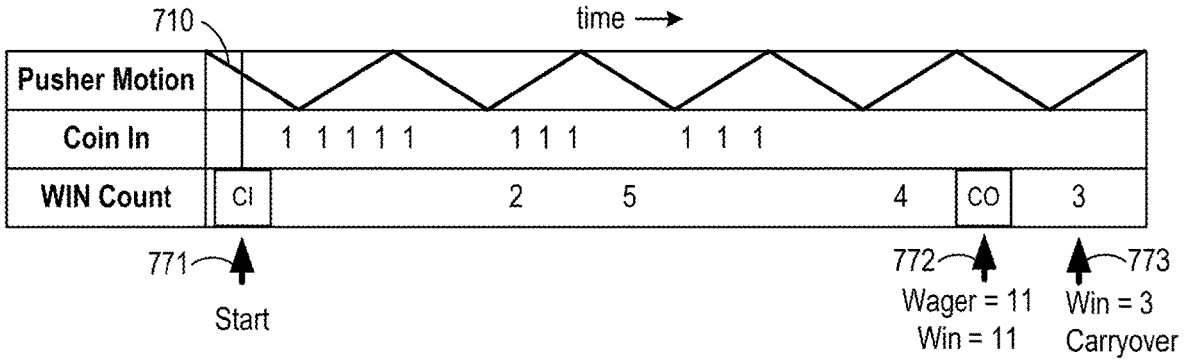

FIG. 7G illustrates a relationship among pusher mechanism motion 710, wagers and win counts for yet another method of defining a game cycle for an improved coin pusher machine, according to some embodiments.

In FIG. 7G, a game cycle is defined to begin when a player inserts money or credits into player station 115 and to end when the player presses cash out button 560 (see FIGS. 2, 5, 6A and 6B). As previously described, a player pressing cash out button 570 pays out all accumulated credits via, for example, a ticket printed and supplied to the player via printer/bill acceptor 220.

For example, a first game cycle starts at 771, when the player inserts money or credits into player station 115 in any manner previously described or in any other manner. As can be seen, after the start of the first game cycle at 771, five tokens are sequentially introduced by the player and substantially at the same time a first of a next three token is introduced by player, two tokens fall into "win" slot 520. Five additional tokens subsequently fall into "win" slot 520. Next, the player sequentially introduces three more tokens to pusher field 515 and sometime after this, four more tokens fall into "win" slot 520. Sometime after this, the first game cycle ends at 772, when the player presses cash out button 560. Accordingly, the first game cycle would have eleven tokens wagered and eleven tokens won.

As shown, at a time subsequent to time 772, three more tokens fall into "win" slot 520. These are not accounted for in the first game cycle, which ended at 772. Though the second game cycle does not begin until a player subsequently inserts money or credits into player station 115, the three tokens that fell into "win" slot 520 are carried over (as shown by 773) to the second game cycle once it begins in order to capture them as being at least a portion of a player payback.

Figure 8:
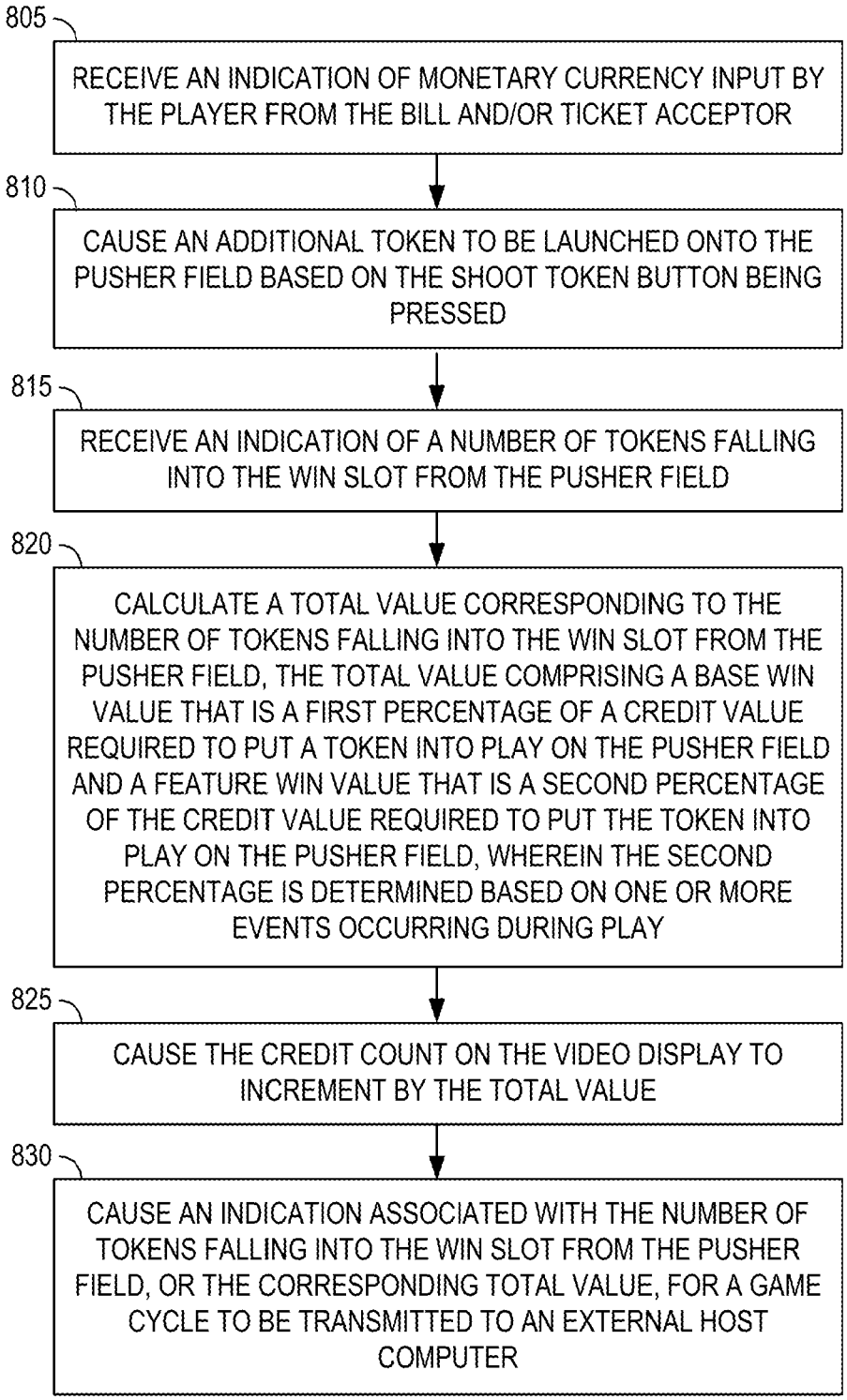
FIG. 8 is a flowchart illustrating example operation of an improved coin pusher machine, according to some example embodiments.

FIG. 8 is a flowchart 800 illustrating example operation of an improved coin pusher machine, according to some example embodiments. Such example operation may be implemented by software executed by a processor, such as within game control CPU 105, CPU 210 of a particular player station 115, or other processors in communication with either or both of CPU 105 and/or CPU 210. Accordingly, flowchart 800 will be described in connection with FIGS. 1-7, as previously described.

Although certain steps, actions or blocks are described herein, the present disclosure is not so limited and one or more steps, actions or blocks described herein may be performed in a different order, one or more steps, actions or blocks may be omitted, and/or one or additional more steps, actions or blocks may be performed without departing from the scope of the present disclosure.

Block 805 includes receiving an indication of monetary currency input by the player from the bill and/or ticket acceptor. For example, CPU 210 of player station 115 may be configured to receive an indication of monetary currency being input by the player from printer/bill acceptor 220 (see FIG. 2).

Block 810 includes causing an additional token to be launched onto the pusher field based on the shoot token button being pressed. For example, CPU 210 of player station 115 may be configured to cause token launching mechanism 525 to launch an additional token onto pusher field 515 based on the player pressing shoot token button 560 (see FIGS. 2, 5, 6A and 6B).

Block 815 includes receiving an indication of a number of tokens falling into the win slot from the pusher field. For example, CPU 210 of player station 115 may be configured to receive an indication of a number of tokens 510 falling into "win" slot 520, from pusher field 515 (see FIGS. 2, 5, 6A and 6B). The indication may be received from token counter 255, which is configured to count and/or track tokens, coins or chips 510 that fall into "win" slot 520 (see FIGS. 5, 6A and 6B).

Block 820 includes calculating a total value corresponding to the number of tokens falling into the win slot from the pusher field, the total value comprising a base win value that is a first percentage of a credit value required to put a token into play on the pusher field, and a feature win value that is a second percentage of the credit value required to put the token into play on the pusher field, wherein the second percentage is determined based on one or more events occurring during play. For example, CPU 210 of player station 115 may be configured to calculate or determine a total value corresponding to the number of tokens 510 falling into win slot 520 from pusher field 515, utilizing a combination of the base win value and the feature win value as previously described in connection with at least FIGS. 5, 6A and 6B)

Block 825 includes causing the credit count on the video display to increment by the total value. For example, CPU 210 of player station 115 may be configured to cause the credit count on video display 245 to increment by the total value (see FIGS. 2, 5, 6A and 6B).

Block 830 includes causing an indication associated with the number of tokens falling into the win slot from the pusher field or the corresponding total value for a game cycle to be transmitted to an external host computer. For example, CPU 210 of player station 115 may be configured to cause an indication associated with the number of tokens 510 falling into win slot 520 from pusher field 515, or the corresponding total value as determined in block 820, for a game cycle to be transmitted to external casino host computer 310 (see FIGS. 2-6B).

CPU 210 may be configured to determine and/or define a game cycle according to any method or protocol previously described in connection with FIGS. 7A-7G. For example, as previously described in connection with FIG. 7A, a game cycle may be defined as beginning when the pusher mechanism is oriented in a predetermined position and ending when the pusher mechanism first returns to the predetermined position after at least one token is introduced to the pusher field during the game cycle. Alternatively, as previously described in connection with FIG. 7B, beginning at an end of an immediately previous game cycle and ending at an expiration of a predetermined interval of time during which at least one token is first introduced to the pusher field by the player after a start of the game cycle. Alternatively, as previously described in connection with FIG. 7C, beginning at the end of the immediately previous game cycle and ending upon introduction of a predetermined number of tokens to the pusher field by the player. Alternatively, as previously described in connection with FIG. 7D, beginning at the end of the immediately previous game cycle and ending when the token counter completes a count of tokens that have fallen into the win slot at substantially a same time and after at least one token is introduced to the pusher field by the player during the game cycle. Alternatively, as previously described in connection with FIG. 7E, beginning at the end of the immediately previous game cycle and ending when a predetermined number of tokens fall into the win slot during the game cycle. Alternatively, as previously described in connection with FIG. 7F, beginning at the end of the immediately previous game cycle and ending when the player presses the take win button. Alternatively, as previously described in connection with FIG. 7G, beginning when the player inserts the monetary currency or the ticket into the bill and/or ticket acceptor and ending when the player presses the cash out button.

Software

Reference to software in the present disclosure may encompass one or more computer programs that may encompass data, instructions, or both.

One or more tangible and non-transitory computer-readable media may store or otherwise embody software implementing particular embodiments. A tangible computer-readable medium may be any tangible medium capable of carrying, communicating, containing, holding, maintaining, propagating, retaining, storing, transmitting, transporting, or otherwise embodying software, where appropriate. A tangible computer-readable medium may be a biological, chemical, electronic, electromagnetic, infrared, magnetic, optical, quantum, or other suitable medium or a combination of two or more such media, where appropriate. Example tangible, non-transitory computer-readable media include, but are not limited to, application-specific integrated circuits (ASICs), compact discs (CDs), field-programmable gate arrays (FPGAs), floppy disks, floptical disks, hard disks, holographic storage devices, magnetic tape, caches, programmable logic devices (PLDs), random-access memory (RAM) devices, read-only memory (ROM) devices, semiconductor memory devices, and other suitable computer-readable media.

Software implementing particular embodiments may be written in any suitable programming language (which may be procedural or object oriented) or combination of programming languages, where appropriate. Any suitable type of computer system (such as a single- or multiple-processor computer system) or systems may execute software implementing particular embodiments, where appropriate. A general-purpose or specific-purpose computer system may execute software implementing particular embodiments, where appropriate.

Further examples are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the present disclosure. In addition, any module processor, mechanism or device described herein as being configured to perform any action, task, method, or protocol may, where appropriate, be understood to include one or more circuits and/or circuitry specifically having sufficient and appropriate structure to actually perform the recited action, task, method, or protocol.

What is claimed is:

1. A coin pusher machine comprising:

at least one memory device;

at least one game control processor in communication with the at least one memory device and configured to be in communication with at least one external host computer;

at least one player station; and a controller configured to communicatively couple at least one of a video display, a speaker, a peripheral device, and the at least one player station to the at least one game control processor, wherein each of the at least one player station comprises:

at least one player station memory device;

at least one processor in communication with at least the at least one player station memory device;

a currency acceptor configured to receive a physical indicium of currency from a player;

at least one input device;

at least one display device configured to display a credit count;

a pusher field having:

a substantially horizontal surface configured to hold a plurality of tokens; and a win slot configured to accept tokens that fall from the pusher field;

a pusher mechanism configured to move in a back-and-forth motion across a portion of the horizontal surface of the pusher field;

a token launching mechanism configured to launch an additional token onto the pusher field; and a token counter configured to count a value of tokens that fall into the win slot, wherein the at least one processor is configured, for a play of the pusher machine, to:

i) receive an indication of monetary currency input by the player from the currency acceptor;

ii) cause the displayed credit count to increment based on the received indication of monetary currency;

iii) cause the additional token to be launched onto the pusher field based on a play input being received from the player by the at least one input device;

iv) cause the displayed credit count to decrement based on the received play input;

v) receive from the token counter an indication of a total credit value of tokens falling into the win slot, the total credit value being a total value required to put the tokens falling into the win slot onto the pusher field;

vi) calculate a total win value, the total win value comprising:

a base win value that is based on a first percentage of the value of tokens falling into the win slot, wherein the first percentage is less than 100% of the total credit value; and a feature win value that is based on one or more events occurring during the play of the coin pusher machine; and vii) cause the displayed credit count to increment by the total win value without incrementing a credit count at any other player station by a remaining value of the total credit value.

2. The coin pusher machine of claim 1, wherein the at least one processor is further configured to cause an indication of the total credit value of tokens falling into the win slot for a game cycle to be transmitted to the external host computer.

3. The coin pusher machine of claim 2, wherein the game cycle is defined as beginning when the pusher mechanism is oriented in a predetermined position and ending when the pusher mechanism first returns to the predetermined position after at least one token is introduced to the pusher field.

4. The coin pusher machine of claim 2, wherein the game cycle is defined as beginning at an end of an immediately previous game cycle and ending at an expiration of a predetermined interval of time during which at least one token is first introduced to the pusher field.

5. The coin pusher machine of claim 2, wherein the game cycle is defined as beginning at the end of an immediately previous game cycle and ending upon introduction of a predetermined number of tokens to the pusher field.

6. The coin pusher machine of claim 2, wherein the game cycle is defined as beginning at the end of an immediately previous game cycle and ending when the token counter completes a count of tokens that have fallen into the win slot at substantially a same time and after at least one token is introduced to the pusher field.

7. The coin pusher machine of claim 2, wherein the game cycle is defined as beginning at the end of an immediately previous game cycle and ending when a predetermined number of tokens fall into the win slot.

8. The coin pusher machine of claim 2, wherein the game cycle is defined as beginning at the end of an immediately previous game cycle and ending when an indication is received of a take win input by the player.

9. The coin pusher machine of claim 2, wherein the game cycle is defined as beginning at the end of an immediately previous game cycle and ending when an indication is received of a cash out input by the player.

10. The coin pusher machine of claim 1, wherein the token counter is configured to count the total credit value of tokens that fall into the win slot by counting a number of tokens that fall into the win slot.

11. The coin pusher machine of claim 1, wherein the feature win value is based at least in part on a displayed plurality of reels.

12. The coin pusher machine of claim 1, wherein the feature win value is based at least in part on an additional input received by the player.

13. The coin pusher machine of claim 1, wherein the feature win value is based at least in part on a random number generator.

14. The coin pusher machine of claim 1, wherein for a number of plays of the coin pusher machine, a total of the calculated total win values for each of the number of plays is less than a total of a monetary value associated with each of the additional tokens launched in each of the number of plays.

15. The coin pusher machine of claim 14, wherein the total of the calculated total win values for each of the number of plays divided by the total of a monetary value associated with each of the additional tokens launched in each of the number of plays is a payback rate of the coin pusher, and the payback rate is between 85% and 99%.

16. A method of operating a coin pusher player station, the method comprising:

receiving an indication of physical monetary currency input by a player from a currency acceptor;

causing a display device to display credit count incrementing based on the received indication of physical monetary currency;

beginning a play of the coin pusher player station by causing an additional token to be launched onto a pusher field based on a play input being received from a player by at least one input device;

causing the displayed credit count to decrement based on the received play input;

receiving from a token counter an indication of a total credit value of tokens falling into a win slot, the total credit value being a total value required to put the tokens falling into the wing slot onto the pusher field;

calculating a total win value, the total win value comprising:

a base win value that is based on a first percentage of the value of tokens falling into the win slot, wherein the first percentage is less than 100% of the total credit value; and a feature win value that is based on one or more events occurring during the play of the coin pusher player station; and causing the displayed credit count to increment by the total win value without incrementing a credit count at any other player station by a remaining value of the total credit value.

17. The method of claim 16, wherein the feature win value is based at least in part on a random number generator.

18. The method of claim 16, wherein for a number of plays of the coin pusher player station, a total of the calculated total win values for each of the number of plays is less than a total of a monetary value associated with each of the additional tokens launched in each of the number of plays.

19. The method of claim 16, further comprising providing the total win value to the player.

20. The method of claim 16, further comprising causing an indication of the total credit value of tokens falling into the win slot for a game cycle to be transmitted to the external host computer.

* * * * *